United States Patent [19]

Delplanque

[11] Patent Number: 4,793,507

[45] Date of Patent: Dec. 27, 1988

[54] FOLDING PACKAGING CASE

[76] Inventor: Alain Delplanque, 24, Av. Mont des Louviers, 59250 Halluin, France

[21] Appl. No.: 37,689

[22] Filed: Apr. 13, 1987

[51] Int. Cl.[4] ..... B65D 5/36

[52] U.S. Cl. ..... 217/13; 206/600; 217/14; 217/65; 217/69; 229/41 R; 229/49; 493/311

[58] Field of Search ..... 229/41 R, 41 B, 48 R, 229/49; 206/386, 600; 217/13, 14, 43 R, 43 A, 46, 65, 69; 493/311, 379, 386

[56] References Cited

U.S. PATENT DOCUMENTS

| | | | |
|---|---|---|---|
| 906,208 | 12/1908 | Dewey et al. | 217/69 |
| 1,162,524 | 11/1915 | Staley et al. | 229/DIG. 4 |
| 1,542,927 | 6/1925 | Whitaker | 217/46 |
| 3,291,364 | 12/1966 | Fischer | 206/600 |
| 3,654,053 | 4/1972 | Toedter | 229/DIG. 4 |
| 3,752,349 | 8/1973 | Rana | 217/14 |

FOREIGN PATENT DOCUMENTS

| | | | |
|---|---|---|---|
| 524648 | 12/1953 | Belgium | 217/43 R |
| 483559 | 10/1929 | Fed. Rep. of Germany | 217/46 |
| 2202920 | 8/1973 | Fed. Rep. of Germany | 217/43 A |
| 527910 | 11/1921 | France | 217/46 |
| 1036906 | 9/1953 | France | 217/14 |
| 1170848 | 1/1959 | France | 217/14 |
| 1365176 | 5/1964 | France | 217/14 |
| 534398 | 10/1955 | Italy | 229/49 |
| 12474 | of 1899 | United Kingdom | 229/49 |

*Primary Examiner*—Stephen Marcus
*Assistant Examiner*—Gary E. Elkins
*Attorney, Agent, or Firm*—Collard, Roe & Galgano

[57] ABSTRACT

This folding packaging case or box of parallelipipedic configuration comprises a bottom, a front panel, a back panel and two lateral panels, and a folding lid, the various panel elements being hingedly interconnected by flexible joints. The bottom comprises at least one joint through which it is hingedly connected to one of the lateral panels, and a peripheral ledge engageable by the peripheral panels so as to lock the peripheral panels in position and thus permit the assembling of the case into a rigid structure.

9 Claims, 3 Drawing Sheets

FOLDING PACKAGING CASE

FIELD OF THE INVENTION

The present invention relates to folding packaging cases and is directed more particularly to the manufacture of wooden or cardboard cases for packaging products.

For many years packaging cases have been widely used for gathering and protecting products disposed in the inner space of the case. Two types of materials, wood and cardboard, are mainly used in the manufacture of packaging cases of this type.

Cardboard is cheaper than wood but its mechanical resistance is inferior. However, carboard is advantageous in that folding corners are easily obtained in this material by forming rectilinear fold lines, a feature unknown with wood which, on the other hand, lacks the flexibility of cardboard and therefore affords a better protection of the contents against external stresses.

THE PRIOR ART

Two main types of packaging cases and boxes are known and widely used: packagings of the non-returnable type and packagings returnable, generally against payment of a moderate deposit. Whereas during a period of low-cost energy non-returnable packagings have been widely used in many business concerns, the increased cost of energy and raw materials led to a recrudescence in the interest for returnable cases and boxes. In this trend, wood appears to take the lead.

When the case is returned empty to the dealer or shop, it is desirable that it occupies only a very reduced volume for obvious reasons, notably a lower transport cost. Under these conditions, folding cases or boxes have been marketed. Since this type of case utilizes rigid panels, it must be provided with hinge means to permit the easy folding of the case panels so that the panels are suuperposed to one another.

Up to now, piano-type hinges of suitable metal have been generally used for this purpose. However, piano hinges are objectionable for various reasons. More particularly, they are not fluid-tight and therefore allow water to seep in through the joints. Furthermore, fitting these piano hinges is a rather tedious and time-robbing operation requiring the use of many screws or nails. Finally, they are relatively expensive.

In addition, the use of metal hinges increases considerably the manufacturing cost of folding cases and on the other hand these metal hinges constitute weak points of folding cases since they are subject to oxidation and corrosion. In most instances they cannot be replaced since the screws, when fitted initially, cause permanent damages to the wood so that it is not possible to fit the screws of a new hinge in the holes of the old screws.

These inconveniences are obviously detrimental to the development of folding packaging cases, and this is all the more to be regretted if one considers the many advantageous features of folding cases.

From the point of view of handling, to facilitate the transport of packaging cases these are disposed as a rule on pallets which can then be easily handled by using a fork lift truck. However, the absence of means for anchoring the packaging case to the pallet may prove detrimental since the case may slip on the pallet and even fall down on the floor. Moreover, under these conditions no stacking should be allowed due to the risk arising from the instability of a stack of several independent cases.

SUMMARY OF THE INVENTION

It is the essential object of the present invention to provide a folding case the manufacture of which is on the one hand facilitated and on the other hand particularly economical due to the specific nature of the component elements of the case.

In fact, according to the present invention, packaging cases having exactly the desired dimensions and meeting the customer's requirements can be mass-produced independently of the various sizes required. This specific feature is particularly advantageous from the point of view of manufacturing costs.

This reduction in the manufacturing cost of a packaging case is attended by a considerable improvement in the hinge quality and useful life. In fact, the hinge device of the present invention can be exposed to weather conditions without undergoing any damage, permit pivotal movements and are free of any hard points, this result being obtained in a particularly simple way.

These various objects and features are achieved by using a hinge device constituting the original object of the present invention and which can be manufactured and assembled very easily. In addition, this hinge device is adaptable to various case sizes while facilitating the fitting thereof to panels and similar elements to be assembled and hingedly interconnected.

If necessary, the hinges may be replaced even by unskilled hands in a very short time without having to remove the faulty hinges. Therefore, the useful life of the case is independent of that of the hinges.

Moreover, the folding packaging case according to the present invention is particularly fluid-tight and has a good mechanical strength in the hinge areas. The products contained in the inner space of the case are therefore safely protected against external agents.

It is another object of the present invention to provide a folding packaging case that can be easily handled and stacked. More particularly, the folding packaging case of the present invention has the same handling characteristics as those of conventional pallets. Moreover, the folding packaging case according to this invention can be stacked without any risk.

Other features and advantages of the present invention will appear from the following description of a preferred form of embodiment given only by way of example, not of limitation.

According to the present invention, the folding case constituting a packaging means for the storage, handling and transport of various products, said case having a parallelipipedic configuration and comprising a bottom, a front panel and a back panel, a pair of lateral panels and a folding lid, said panels being hingedly interconnected by means of flexible hinge means, is characterised in that the bottom comprises at least one hinged connection with one of the lateral panels and a peripheral ledge so that the peripheral panels can bear on this ledge and be locked in position thereon and thus permit the conversion of the assembly into a case.

THE DRAWINGS

FIG. 1 is a perspective view showing the external and general shape of the folding packaging case according to the present invention, FIGS. 2a, 2b, 2c and 2d illustrate diagrammatically the various steps of the folding of the packaging case of this invention, FIG. 3 illustrates the hinged mounting of the back panel on the bottom during the case folding operation, FIG. 4 illustrates diagrammatically the hinged mounting of the back panel on the bottom of the case during the unfolding operation, FIG. 5 illustrates diagrammatically in sectional view a detail of the hinged mounting of the folding lid on the back panel of the packaging case, FIG. 6 is a perspective view of a preferred form of embodiment of the packaging case of this invention, FIG. 7 is a diagrammatic sectional view showing a detail of a first form of embodiment of the hinge means provided, for instance, between a lateral panel and the back panel of the case, and FIG. 8 is another diagrammatical sectional view showing a modified form of embodiment of the hinge means between a lateral panel and the back panel of the case.

DESCRIPTION OF THE PREFERRED EMBODIMENT

The present invention is concerned with packaging cases and boxes, and has specific reference to an improved folding packaging case for storing, protecting and transporting products.

Wood is the preferred material contemplated for manufacturing the packaging case of the present invention, but other materials may also be used, if necessary.

As a rule, the weak points of folding cases consisting of hingedly interconnected panels are the hinge means implemented which permit of folding the case panels on one another.

The conventional, so-called piano hinges are expensive devices difficult to secure to the case panels. Furthermore, in many cases they are liable to oxidation and difficult to replace in case of damage.

Figure 1:
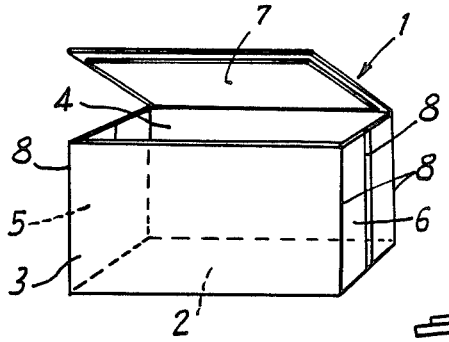
Figure 3:
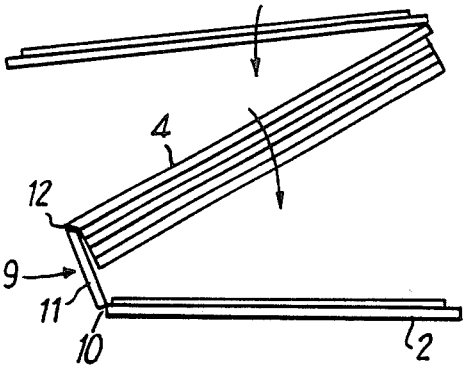

The folding packaging case according to the present invention is illustrated in FIG. 1 and denoted in general by reference numeral 1. In its assembled condition this case has a parallelipipedic configuration and comprises a bottom 2, a front panel 3, a back panel 4, two lateral or side panels 5, 6 and a folding lid 7.

According to the instant invention, these various panels are hingedly interconnected by flexible joints 8. The conventional metal hinges which constituted the weak points of conventional folding cases are dispensed with.

The flexible joints of the present invention consist of strips of fabric or other continuous elements, for example of plasticized film of which the side edges are bonded to the two panels to be hingedly or pivotally interconnected.

This hinge means has a considerable flexibility when folded and if necessary it can easily be repaired since it is only necessary to cover the old fabric strip with a new one, without removing the old strip.

Moreover, by using a strip of flexible and fluid-tight material, leak-free joints can be obtained so as to efficiently protect the products or objects contained in the case 1.

The method of fixing the strip for hingedly interconnecting the case panels consists in pasting the surfaces to be assembled. In fact, a relatively high resistance of the joint can be obtained by resorting to this bonding method which, in addition, can be carried out at a relatively high rate.

The sequence of steps of the joining operation, consisting in folding the various panels of the packaging case illustrated in FIG. 1 is shown diagrammatically in FIGS. 2a, 2b, 2c and 2d of the drawings.

Assuming that the case 1 is in its final condition, for example after use, and must be reduced in volume by folding, the first step (FIG. 2a) consists in opening and folding the lid 7 outwardly until it contacts the back panel 4.

Then, the peripheral front and side or lateral panels 3, 5 and 6 respectively are detached from the bottom 2 of the case since this bottom 2 is normally fitted inside the vertical panels in order to hold these panels in position.

Figure 2A:
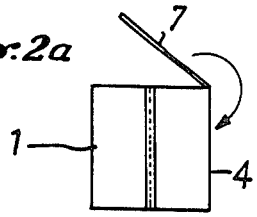
Figure 2B:
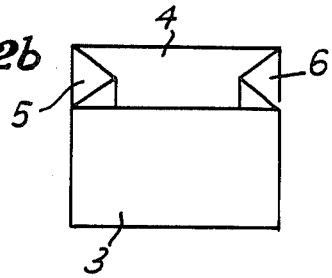
Figure 4:
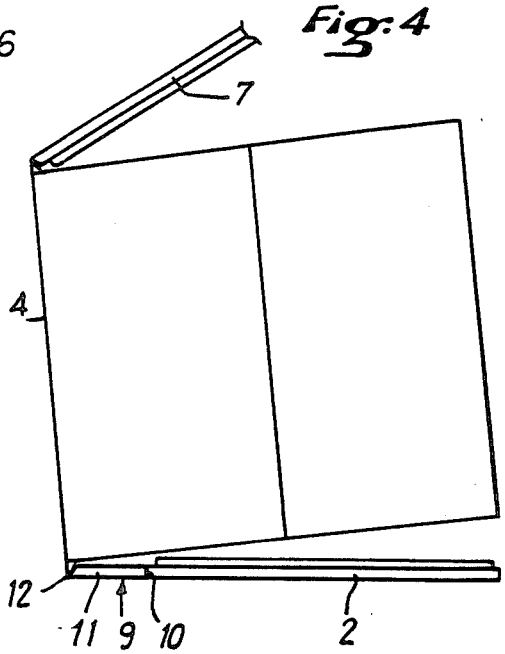

The two side panels 5, 6 consisting each of two hingedly interconnected half-panels are folded on themselves, as illustrated in FIG. 2b. This accordion-like folding step permits of folding the front panel 3 until it engages the back panel 4.

Figure 2C:
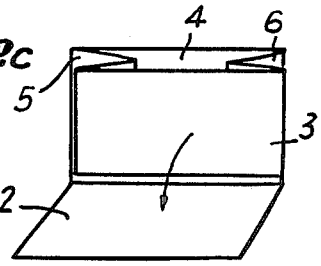

Upon completion of this step, the structure of FIG. 2c is obtained and now the assembly of the front, back and side panels 3, 4, 5 and 6 must be folded on the bottom 2.

Figure 2D:
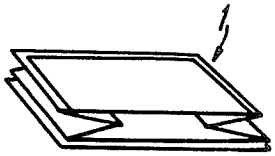

Thus, the packaging case 1 is folded completely and its configuration is reduced to the minimum volume, as illustrated in FIG. 2d. In fact, this minimum volume is obtained by simply stacking the various panels, thus excluding any dead or lost space.

This result is achieved by providing a double joint 9 covering four panel thicknesses and disposed between the bottom 2 and the back panel 4.

This double joint consists in fact of a first hinge 10 formed between the bottom 2 and a rigid intermediate longitudinal panel element 11, and a second hinge 12 disposed between the back panel 4 and the intermediate rigid panel 11. The width of this rigid intermediate longitudinal panel element 11 corresponds to the addition of the thickness of the front panel 3 and that of the rear panel 4, plus the double thickness of the lateral panels 5 and 6, respectively.

When folding the case 1, the longitudinal panel element 11 is disposed along the edges of the above-mentioned panels, and in the assembled condition this longitudinal element 11 is coplanar with the bottom 2.

Figure 5:
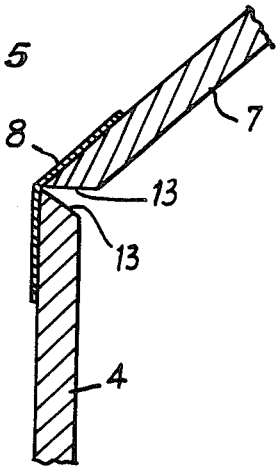

The hinge formed between the lid 7 and the back panel 4 is illustrated in cross-section and on a larger scale in FIG. 5. A flexible connecting hinge strip 8 is disposed on the external surface of the various elements. To properly position the lid 7 during the closing movement thereof, a bevel 13 is formed on the edges of each panel 4, 7 which face the inner space of the case. A 45-degree bevel is fully satisfactory for the purpose.

Figure 7:
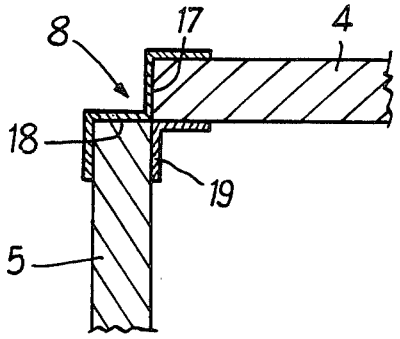
Figure 8:
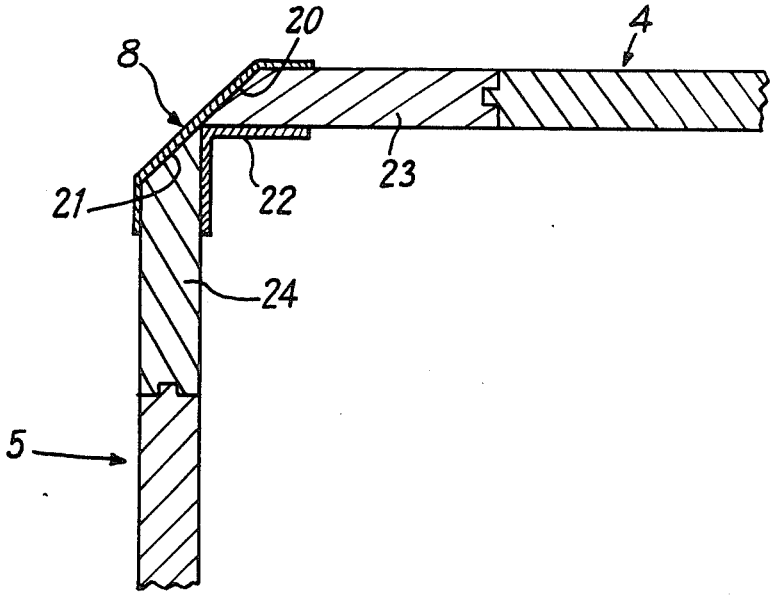

The hinge formed between the lateral panels 5, 6 and the front and rear panels 3, 4 is shown in detail in FIGS. 7 and 8 illustrating diagrammatically two different forms of embodiment of side panel 5 and back panel 4, respectively.

FIG. 7 illustrates a first form of embodiment which does not require any particular machining of the edges of the panels constituting the walls 3–6 of the case. A flexible connecting joint 8 is disposed between the two edges 17, 18 of panels 4 and 5, respectively.

Moreover, to complete this assembly and improving the strength of the hinge means 8, a flexible joint 19 may also be provided in the inner corner formed between panels 4 and 5.

FIG. 8 shows a second form of embodiment of hinge means 8 constituting a flexible joint between two panels 4 and 5 of the walls 3–6 of a folding case 1.

This hinge means consists of a pair of rigid elements 23, 24 disposed side by side and interconnected by a flexible joint 8 comprising at least one first continuous strip of a material adapted to be folded repeatedly and bonded to the two rigid elements 23, 24 along their adjacent edges 20, 21 on the outer side of the hinge, and at least another strip 22 of the same material as the first strip, which is bonded to the two rigid elements 23, 24 on the inner side of the hinge.

The edges 20, 21 of said rigid elements 23, 24 are contiguous along at least one of their edges, on the inner side of the hinge means, the first strip 8 of the flexible joint being bonded longitudinally to the adjacent edges 20 and 21.

In this specific form of embodiment te registering edges 20, 21 are bevelled, along the adjacent edges of rigid elements 23, 24, each bevel being disposed externally with respect to the hinge means, and such that when the hinge is opened to its operative position the surfaces of bevels 20, 21 are substantially coplanar, as shown in FIG. 8.

Thus, the flexible joint 8 interconnecting the two edges 20 and 21 is disposed on and bonded to this solid portion.

This arrangement is advantageous notably when inner thrusts are exerted against the panels and its strength is greater than that of the first form of embodiment (FIG. 7).

It will be seen that the strength of the first strip is improved by the presence of the second flexible strip 22. However, this effect may be enhanced if the first strip 8 bonded to bevels 20, 21 projects on the outer surface of panels 23 and 24, externally of the hinge, as shown in FIG. 8.

On the other hand, FIG. 8 shows a particularly attractive and advantageous form of embodiment of the hinge means of the present invention. In fact, this modified form of embodiment consists in assembling two rigid longitudinal elements 23, 24 having their edges covered by flexible bonding joints 8 and 22.

These elements are subsequently assembled with the panels proper 4 and 5, by using any suitable method, such as a groove-and-tongue assembling joint or the like.

This arrangement is also advantageous because it permits the manufacturing of the case corners continuously and to obtain hinge means without taking into account the actual dimensions of side walls 3–6.

Figure 6:
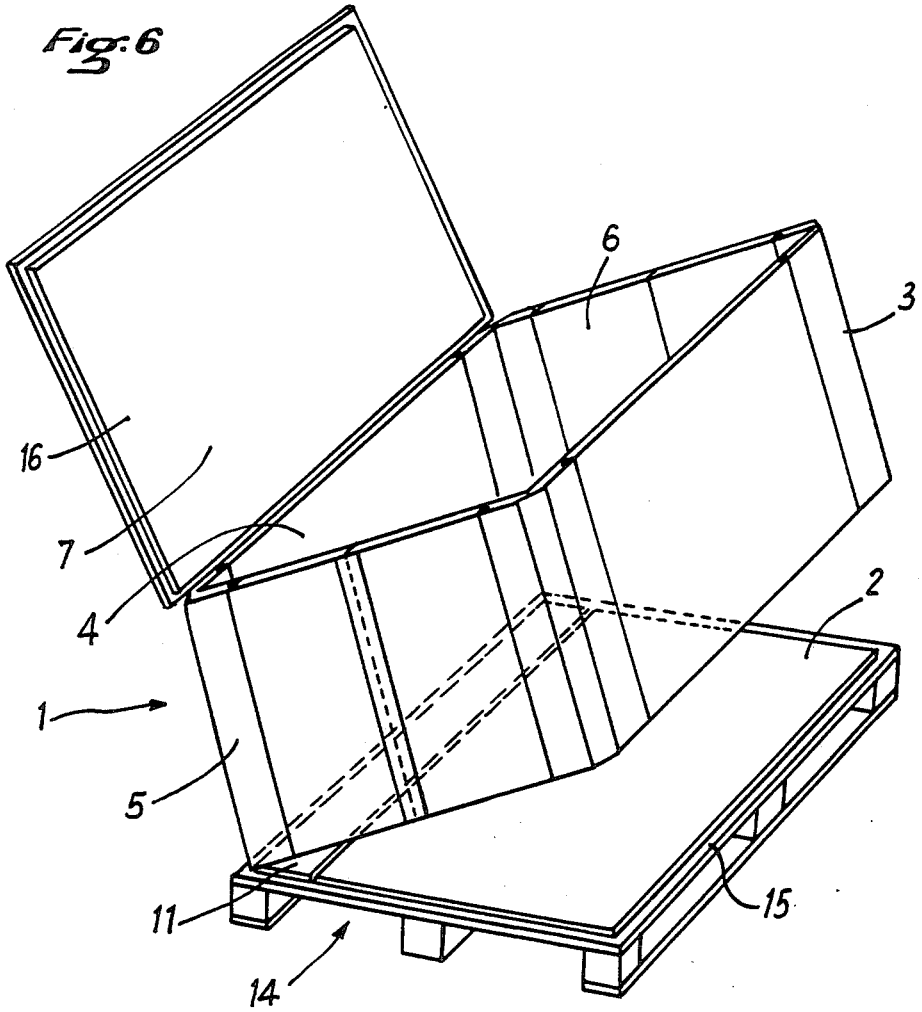

FIG. 6 illustrates a preferred form of embodiment of the packaging case 1 according to the present invention. In this form of embodiment, the folding packaging case is associated with a pallet 14 for facilitating the handling and permitting the stacking of several case-and-pallet assemblies.

The bottom 2 is secured directly to the top surface of pallet 14. However, a narrow ledge 15 is left around the periphery of the case bottom 2 so that the lateral or peripheral panels 3, 5 and 6 can bear on this ledge 15. Thus, the lateral panels 3, 5 and 6 encompass the bottom 2 which prevents any undesired folding of the lateral panels 5 and 6.

On the other hand, the operative configuration of case 1 is reinforced by the provision of an inner ledge 16 on the inner surface of lid 7, the function of this ledge 16 consisting in enframing internally the peripheral panels 3, 5 and 6.

Of course, other forms of embodiment of the present invention may be conceived by those conversant with the art without departing from the basic principles of the invention.

I claim:

1. A collapsible rectangular packing case comprising:

a pair of side panels, each of said side panels having two articulated sections interconnected by a flexible joint, said sections being capable of folding over one another within an interior of said rectangular packing case;

a front panel connected to corresponding edges of said side panels by flexible joints;

a rear panel connected to corresponding edges of said side panels opposite said front panel by flexible joints;

a cover panel connected by a flexible joint to one of said front, rear or side panels along a free edge of said one panel, said cover having support means along its contour to support at least three of said front, rear and side panels prior to the collapse of said case;

a rigid intermediate panel connected by a flexible joint to an edge of said one panel opposite said free edge connected to said cover; and a bottom panel connected to said rigid intermediate panel by a flexible joint, said bottom panel having support means along its contour serving to support at least three of said front, rear and side panels prior to the collapse of said case, said rigid intermediate panel having a width between said flexible joints with said one panel and said bottom panel at least equal to the sum of a thickness of each of said two sections of said side panels, said rear panel and said front panel.

2. A collapsible packing case, as set forth in claim 1, wherein said bottom panel is substantially rectangular in shape and having one side thereof fixed to the surface of a pallet, said panel having a length and width less than that of the pallet so as to define said support means along the contour thereof.

3. A collapsible packing case, as set forth in claim 1, wherein said front panel, said rear panel and said two side panels joined by said flexible joints are arranged relatively, side by side, so that respective flat sides thereof are contiguous along at least one edge thereof, each of said flexible joints having at least first and second continuous bands of material which can be folded repetitively, fastened to said peripheral panels along their said contiguous edges, said first band fastened on an outer side of said panels, and said second band fastened along said contiguous edges on an inner side of said panels.

4. A collapsible packing case as set forth in claim 3, wherein said contiguous edges of said panels are provided with an external bevel, said bevel angled such that when said flexible joint is in a position of use, said bevels on said continguous edges are substantially coplanar.

5. A collapsible packing case as set forth in claim 1, wherein said flexible joints connecting said front, rear and side panels comprise hinge means formed from two rigid elements placed adjacent one another in a side-by-side relationship and joined together by said flexible joint, said flexible joint being in the form of at least a first and a second continuous band of repetitively pliable material fastened to said two rigid elements along adjacent sides thereof, said first continuous band fastened on adjacent outer sides of said rigid elements, and said second band fastened to said rigid elements on inner sides thereto.

6. A collapsible packing case as set forth in claim 5, wherein the edges of said adjacent sides of said two rigid elements are contiguous along the inner sides of said hinge, said outer sides of said rigid members being provided with an outwardly facing bevel, said bevel angled so that when said hinge is in the position of use, said bevels are substantially coplanar, said first band forming said flexible joint being fastened to flat sides of said outer sides adjacent said bevel on each of said rigid members.

7. A collapsible packing case as set forth in claim 1 wherein said flexible joints are in the form of continuous fabric bands whose edges are fastened to the two panels to be joined.

8. A collapsible packing case as set forth in claim 7, wherein said bands are made of a waterproof material and glued to the panels to be joined.

9. A method for collapsing a rectangular packaging case having a cover, a bottom and four peripheral panels interconnected by flexible joints with the cover connected to one of the peripheral panels by a flexible joint, and having a rigid intermediate longitudinal panel element flexibly connected to one longitudinal side thereof to the bottom panel and on the other longitudinal side thereof to the one peripheral panel connected to said cover, said method comprising the steps of:

initially opening and folding the cover outwardly until it contacts an outer surface of said one peripheral panel connected thereto;

detaching said peripheral panel opposite said one peripheral panel connected to said cover and said two peripheral panels contiguous to said one peripheral panel connected to said cover from said bottom of said case, said two peripheral panels contiguous to said one peripheral panel connected to said cover, each having two sections thereof joined by a flexible joint;

folding each of said two contiguous peripheral panels inwardly along said flexible joint connecting said sections thereof;

folding said one peripheral panel with said cover, said contiguous panels and said opposite panel onto said bottom; and folding said rigid intermediate longitudinal panel element vertically upward along the flexible longitudinal joint between said intermediate longitudinal panel element and said bottom such that said intermediate rigid panel extends vertically upwards forming a reinforced backing for the collapsed case.

* * * * *